US009284636B1

(12) United States Patent
Lee

(10) Patent No.: US 9,284,636 B1
(45) Date of Patent: Mar. 15, 2016

(54) IMPACT TOUGHNESS AND HEAT TREATMENT FOR CAST ALUMINUM

(75) Inventor: Jonathan A Lee, Madison, AL (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 1119 days.

(21) Appl. No.: 13/333,283

(22) Filed: Dec. 21, 2011

(51) Int. Cl.
*C22F 1/043* (2006.01)

(52) U.S. Cl.
CPC ..... *C22F 1/043* (2013.01)

(58) Field of Classification Search
CPC ..... C22F 1/043; C22F 1/05
See application file for complete search history.

(56) References Cited

U.S. PATENT DOCUMENTS

| | | | | |
|---|---|---|---|---|
| 5,336,344 | A | 8/1994 | Wei | |
| 5,582,659 | A * | 12/1996 | Hashimoto et al. | 148/549 |
| 5,837,070 | A * | 11/1998 | Sainfort | C22F 1/043 148/552 |
| 5,981,919 | A | 11/1999 | Masten, Jr. | |
| 7,226,641 | B2 | 6/2007 | Vega et al. | |
| 7,503,986 | B2 | 3/2009 | Kamat et al. | |
| 7,694,713 | B2 | 4/2010 | Martinez Sanchez et al. | |
| 7,797,832 | B2 | 9/2010 | Kamiya | |
| 2003/0143102 | A1 * | 7/2003 | Matsuoka | C22C 21/04 420/546 |
| 2005/0224145 | A1 * | 10/2005 | Laslaz | C22C 21/02 148/439 |
| 2007/0102071 | A1 | 5/2007 | Druschitz | |
| 2009/0320963 | A1 | 12/2009 | Wang | |
| 2010/0224289 | A1 | 9/2010 | Wang et al. | |
| 2010/0224293 | A1 | 9/2010 | Wang et al. | |

FOREIGN PATENT DOCUMENTS

JP 11172390 A * 6/1999

OTHER PUBLICATIONS

A.L. Kearney, Properties of Cast Aluminum Alloys, Properties and Selection: Nonferrous Alloys and Special-Purpose Materials, vol. 2, ASM Handbook, ASM International, 1990, p. 152-177.*

K.T. Kashyap et al., "Casting and Heat Treatment Variables of Al—7Si—Mg Alloy," Materials Science and Technology, Mar. 1993, pp. 189-203, vol. 9.

* cited by examiner

*Primary Examiner* — Roy King
*Assistant Examiner* — Janelle Morillo
(74) *Attorney, Agent, or Firm* — Absolute Technology Law Group, LLC; James J. McGroary

(57) ABSTRACT

A method for transforming a cast component made of modified aluminum alloy by increasing the impact toughness coefficient using minimal heat and energy. The aluminum alloy is modified to contain 0.55%-0.60% magnesium, 0.10%-0.15% titanium or zirconium, less than 0.07% iron, a silicon-to-magnesium product ratio of 4.0, and less than 0.15% total impurities. The shortened heat treatment requires an initial heating at 1,000° F. for up to 1 hour followed by a water quench and a second heating at 350° F. to 390° F. for up to 1 hour. An optional short bake paint cycle or powder coating process further increases the impact toughness coefficient of the cast component.

11 Claims, 2 Drawing Sheets

IMPACT TOUGHNESS AND HEAT TREATMENT FOR CAST ALUMINUM

FEDERAL RESEARCH STATEMENT

The invention described herein was made by an employee of the United States Government and may be manufactured and used by or for the Government of the United States of America for governmental purposes without the payment of any royalties thereon or therefor.

CROSS-REFERENCES TO RELATED APPLICATIONS

None.

FIELD OF INVENTION

The present invention relates to a method and system for transforming modified cast aluminum components, specifically by increasing the impact toughness coefficient of the aluminum alloy.

TERMINOLOGY

As used herein, the term "modified aluminum alloy" refers to an alloy which contains an optimized product of magnesium-to-silicon, titanium or zirconium additions, and a reduction of impurities that include iron and copper so it can be strengthened during a brief cycle of heat treatment.

As used herein, the term "impact toughness coefficient" is defined as the maximum amount of impact energy per unit volume that a material can absorb without fracturing. Impact toughness coefficient is measured in joules per cubic meter ($J/m^3$) in the metric system, and inch-pound-force per cubic inch ($in\text{-}lbf/in^3$) in US customary units.

BACKGROUND OF THE INVENTION

In recent years, automotive components made from cast aluminum alloys, such as wheels, control arms, rear knuckles, brake calipers, cross members and differential carriers, are finding wider application in the transport and automotive industries. Traditional heavy steel components, like wheels, are being replaced with parts made from cast aluminum alloy, as manufacturers seek to reduce vehicle weight in order to minimize fuel consumption and reduce exhaust emissions. For each 1 kg (2.2 lb) of weight saved, it is estimated that a reduction of carbon dioxide ($CO_2$) emissions by 20 kg (44 lb) is possible for a typical vehicle covering 170,000 km (105,000 mi) of distance travel.

A light weight aluminum wheel not only has a mass reduction effect that reduces emissions and fuel consumption, but it also improves the overall driving performance, passenger comfort, and vehicle road handling characteristics of a vehicle because lighter wheels result in less rotational inertia requirement for the vehicle to accelerate and decelerate.

Additionally, wheels that are made from aluminum offer superior aesthetic appearance over their steel counterparts. Therefore, considerable global research and development activity is currently focused on improving the properties of aluminum wheels and reducing their processing costs.

Most aluminum wheels are currently manufactured from a casting approach or from a forging approach. When compared with a forged wheel, a cast wheel has the advantages of design flexibility and lower cost.

Currently, the most commonly used alloy for cast aluminum components, such as wheels, is the aluminum A356 alloy. The A356 alloy is 92.05% aluminum, 0.20% copper, 0.35% magnesium, 0.10% manganese, 7.00% silicon, 0.20% iron and 0.10% zinc by weight. The alloying elements magnesium and silicon are considered the major aging hardening solutes and contribute to the A356 alloy's increase in impact toughness and other mechanical properties when heat treated.

Since impact toughness is a combination factor of a material's strength and ductility, and it reflects the amount of energy absorbed by a material during impact or fracture, the impact toughness coefficient can be determined by measuring the area underneath the stress-strain curve. By taking the integral of the stress-strain curve, the impact toughness coefficient (M) represents the absorbed energy per unit volume, and the mathematical description is shown below, where: $\epsilon$ is the strain, $\epsilon f$ is the final strain of the material upon failure, and a is the maximum stress value.

$$M = \frac{\text{Energy}}{\text{Volume}} = \int_0^{\varepsilon f} \sigma d\varepsilon$$

Other mechanical properties, such as a material's ductility, shear strength, shear strain and tensile strength may also be improved by the types and amounts of alloying elements added to aluminum.

It has been known that the high crash-worthiness performance for a vehicle wheel requires the wheels material to have high fracture toughness or high strain energy under impact. Unfortunately, the mechanical properties of A356 alloy, such as tensile strengths and ductility, are restricted by the coarseness of the microstructure and casting defects. In order to overcome the mechanical property deficiency, the prior art approach is to design cast aluminum wheels with much thicker cast sections than necessary in order to meet the wheels' crash safety requirements.

A thicker wheel cross sectional design in effect will result in a cast wheel of relatively heavier weight than wheels made from a forging approach. Therefore, there is a need to improve the prior art approach for aluminum A356 alloy.

It has also been a common practice by the casting industry to use the conventional T6 heat treatment in order to produce maximum strength in cast aluminum. The T6 heat treatment has two phases, a solution heat treatment phase and an aging phase. In the solution phase, the A356 (or other alloy being used) is heated to 1000° F. for at least 9 hours, causing the magnesium and silicon in the alloy to dissolve into the aluminum. This creates a single phase alloy containing the hardening agent of magnesium-silicide ($Mg_2Si$). Prior to the aging phase, the A356 is then rapidly cooled by water quenching to prevent the $Mg_2Si$ crystals from re-separating within the alloy.

During the second phase, or aging phase, the A356 alloy is heated to approximately 310° F. for 10 hours and then air cooled, allowing the magnesium and silicon to form a uniform distribution of small $Mg_2Si$ precipitate crystals in nanoscale. This process is called precipitation hardening. The formation of the $Mg_2Si$ precipitates crystals increases the strength of the A356 alloy by up to approximately 30% by using the aging heat treating step.

The T6 heat treatment process is particularly suited for use with the low pressure permanent mold (LPPM) casting process known in the art. The LPPM process uses a permanent mold, usually made of iron or steel. Instead of using gravity to feed molten aluminum alloy into the mold, the LPPM process applies a low atmospheric pressure to the molten alloy, causing the metal to slowly flow into and fill the mold cavity without creating a turbulence air-liquid mixture flow. The LPPM process involves a directional solidification of the molten metal, which in turn results in a finer grain size and better alloy microstructures. For these reasons, the LPPM process creates higher quality castings with low tooling costs and allows for thin walled castings and castings with intricate designs, which are difficult to achieve using other casting processes. The LPPM process, itself, may also increase the mechanical properties of the material up to 10%.

One problem known in the art with the T6 heat treatment is the long time required to complete the process. The entire process of solutioning, quenching and aging could take up to twenty hours or more; therefore, it has a significant cost implication for mass production of cast aluminum wheels and other components.

To speed up the heat treatment process, semi-automatic drop bottom batch furnaces are preferred for premium grade aluminum castings. These drop bottom furnaces prove the shortest time for the water quench step. However, the solution, quench and age steps require specific controls for time and temperature. The controls are developed around a specific load size for the casting in the system at a given point in time.

It is important with the large batch heat treating quantities associated in high volume production to minimize the time difference from first part arrival at target temperature and last part arrival set at target temperature. A lesser time differential between these two events results in greater consistency in improving the mechanical and impact toughness properties of the castings.

Furthermore, after the required T6 heat treatment process to produce maximum strength, aluminum wheels are often powder coated or painted and allowed to dry for a period of time in an oven at a temperature range from 310° F. to 400° F. In order to save energy and time, occasionally the manufacturers would use this paint-bake temperature range, which is similar to that used for the T6's artificial aging process, in order to gain some of the heat treatment strengthening required for optimum mechanical properties. However, the short period of time required to bake the paint (typically less than one hour) is not sufficient to achieve alloy strengths close to the true T6 values without the proper aging process.

Therefore, there is a need for a new method to improve the prior art approach for heat treatment in conjunction with the thermal coating process, in order to yield high mechanical property with substantial energy and cost savings. In particular, there is a need to improve the impact fracture toughness coefficient of a cast aluminum component.

Various attempts to increase the toughness, strength and other properties of aluminum components cast using the A356 alloy have been made. In some instances, the composition of the A356 alloy is altered or variations are made to the T6 heat treatment. In other instances, a combination of both A356 alloy and T6 treatment modifications are used.

For example, U.S. patent application Ser. No. 12/683,186 (Wang, et al) discloses a method for strengthening cast aluminum components by modifying the aluminum alloy used to include 0.3% or more magnesium, 0.8% or more copper, 5% or more silicon and 0.5% or more zinc. However, to maximize the additional strength and toughness which may be potentially created with the modified aluminum alloy, the alloy must be treated using a two-stage solution treatment and a two-stage aging process. The 4-step process, which includes an initial heating, incremental heating, low temperature aging and high temperature aging, does not decrease the time and cost for processing cast aluminum components and results in only a 10% increase in the tensile strength.

The 4-step process is also a non-isothermal process and not applicable to the LPPM casting process.

Similarly, U.S. patent application Ser. No. 12/145,614 (Wang) discloses a modification of the T6 heat treatment method which increases the tensile strength of cast aluminum components by 10-15% while decreasing the heat treatment time by approximately 35%. However, this treatment method uses a non-isothermal process and is only applicable to the solution treatment, and not to the aging treatment. This method is also most suitable for the A319 alloy and will not achieve the same increased impact toughness coefficient for the A356 alloy, which is usually the material of choice for making aluminum wheels.

It is desirable to modify the A356 aluminum alloy to improve its impact toughness coefficient, when heat treated.

It is desirable to decrease the amount of processing time and thermal energy expended in heat treating an aluminum alloy.

It is desirable to decrease the cost of heat treating aluminum alloys.

SUMMARY OF THE INVENTION

The present invention is a method for improving at least one mechanical property of an aluminum alloy by heating the aluminum alloy at a solution treatment temperature for a first period of time, quenching the aluminum alloy, heating the aluminum alloy for a second time period at a second temperature, and cooling the aluminum alloy.

By modifying the A356 aluminum alloy, the mechanical properties, and specifically the impact toughness coefficient, of the component being cast may be further improved. Ideally, the modified A356 aluminum alloy contains 0.55%-0.60% magnesium while keeping the product of silicon (%) to magnesium (%) equal to 4.0, 0.10%-0.15% titanium or zirconium, less than 0.07% iron, and less than 0.15% total impurities.

DETAILED DESCRIPTION

Figure 1:
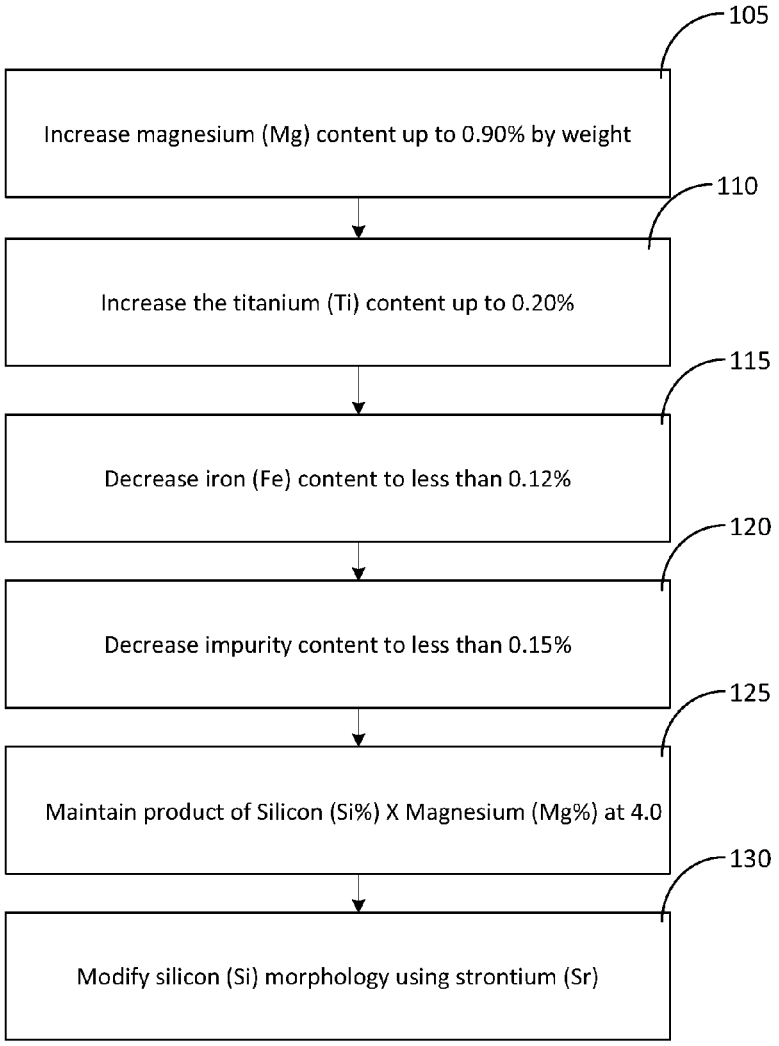
FIG. 1 is a flow chart illustrating exemplary steps for modifying A356 aluminum alloy.

For the purpose of promoting an understanding of the present invention, references are made in the text to exemplary embodiments of a method for improving impact toughness for cast aluminum, only some of which are described herein. It should be understood that no limitations on the scope of the invention are intended by describing these exemplary embodiments. One of ordinary skill in the art will readily appreciate that alternate but functionally equivalent materials, components, and steps may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 is a flowchart illustrating an exemplary method for modifying conventional A356 alloy known in the art to increase tensile strength and ductility, among other mechanical properties. Modifying the A356 alloy as indicated in FIG. 1 also allows the impact toughness coefficient of the material to be increased when treated with a hardening process, such as that illustrated in FIG. 2.

In Step 105, the magnesium (Mg) content of the A356 alloy is increased up to 0.90% by weight. Unmodified A356 alloy has a magnesium content of approximately 0.35%. Preferably, the magnesium content will increase to between 0.55% and 0.60%. A magnesium content of 0.55%-0.06% is a critical range in order to maximize the increased mechanical properties after treatment. Increasing the magnesium content increases the material's hardness. However, too much added magnesium will make the material too brittle and increase the risk of catastrophic failure of the cast component due to low resistance to fracture toughness.

In Step 110, adding titanium (Ti) to increase the titanium content of the A356 alloy up to 0.20%. The unmodified A356 alloy does not contain significant amounts of titanium. Preferably, the titanium content will increase to a critical amount between 0.10% and 0.15%.

In some exemplary embodiments, titanium may be replaced with zirconium (Zr), in an amount up to 0.20%, with a preferred critical amount being between 0.10% and 0.15%. In the exemplary embodiment described, it is preferred to replace the titanium with zirconium.

In Step 115, the iron (Fe) content of the A356 alloy is decreased to less than 0.12%. Unmodified A356 alloy has an iron content of approximately 0.20%. Preferably, the iron content is decreased to a critical amount of less than 0.07%. The ductility is greatly improved by the reduction of iron content in the alloy.

In Step 120, the total impurity content of the A356 alloy is decreased to less than 0.15% total.

In Step 125, the product R of silicon-to-magnesium is maintained at 4.0. Because unmodified A356 alloy contains a silicon content of approximately 7.0%, the amount of silicon in the A356 must be adjusted, dependent on the amount of magnesium, in order to retain the desired product R of 4.0. R is calculated using the formula $R=M\times S$, where M is the percentage of Magnesium in the alloy and S is the percentage of Silicon in the alloy.

The silicon morphology of the A356 alloy must also be modified in Step 130 using strontium (Sr). Modifying the silicon morphology using strontium improves ductility and reduces the heat treatment time.

Figure 2:
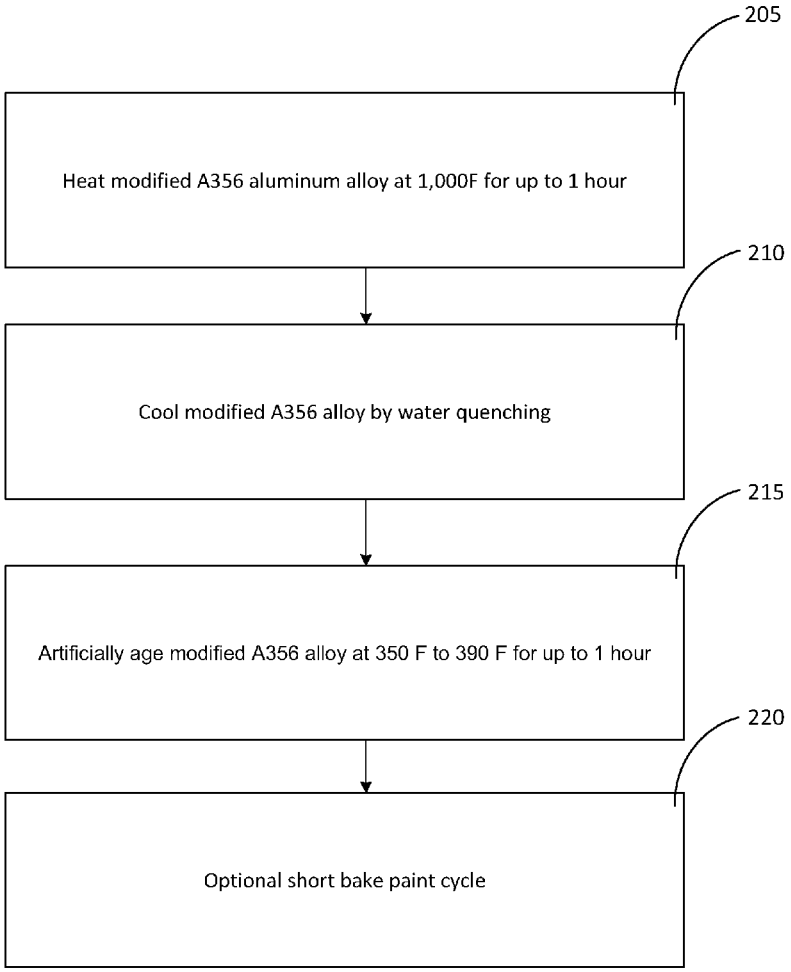
FIG. 2 is a flow chart illustrating exemplary steps for heat treating modified A356 aluminum alloy.

By adjusting the amounts of the elements in the A356 alloy as described, it is possible to increase the impact toughness coefficient of components cast using the modified aluminum alloy by treating it with the process described in FIG. 2.

FIG. 2 is a flowchart illustrating an exemplary method for treating a cast aluminum component made from modified aluminum alloy, as described in FIG. 1, to decrease processing time while maintaining high mechanical properties.

In Step 205, the cast component receives a solution heat treatment at 1,000° F. for up to 1 hour. In the exemplary embodiment described, the cast component is heated in a solutionizing oven configured with software to maintain a constant temperature for the 1 hour duration. In other exemplary embodiments, any oven or heating apparatus capable of providing a constant and equal temperature of 1,000° F. for 1 hour may be used.

In Step 210, the cast component is water quenched, then artificially aged in Step 215 at 350° F. to 390° F. for up to 1 hour.

In the exemplary embodiment described, the cast component may be water quenched using a water quenching apparatus, such as a conveyer apparatus, configured with software to ensure proper quenching. To speed up the heat treatment process, the semi-automatic drop bottom batch furnaces are preferred for premium grade aluminum castings. These drop bottom method furnaces prove the shortest time for the water quench step. In further exemplary embodiments, any apparatus or combination of apparatus may be used to water quench the cast component.

In some exemplary embodiments, an aging oven may be used in Step 215 to artificially age the cast component. An aging oven may be configured with software to specifically heat to a pre-determined temperature in the range of 350° F.-390° F. for a pre-determined time up to 1 hour. In still further exemplary embodiments, an aging oven may be configured to maintain an approximately consistent temperature in the range between 350° F. and 390° F. for up to 1 hour. In yet further exemplary embodiments, any heating apparatus able to maintain a temperature between 350° F. and 390° F. for 1 hour may be used.

The total treatment time is therefore decreased from 12-24 hours as shown in the prior art to 2 hours or less, resulting in substantial energy and cost savings. The reduced handling time following artificial aging (Step 215) allows the cast component to undergo the powder or paint bake thermal coating process sooner.

After the shortened treatment cycle, the cast component may also undergo a short bake paint cycle or powder coating process, as known in the art, in order to further increase the alloy strengths close to the true T6 values (Step 220). In some exemplary embodiments, the short bake paint cycle may be completed by a powder process oven. Because a short bake paint cycle or powder coating process requires the application of heat, treating an aluminum component with a short bake paint cycle or powder coating process results in approximately 32% higher impact toughness over the standard A356 alloy treatment. The treatment described in FIG. 2 also increases the impact toughness coefficient of the final cast aluminum component.

While in the prior art T6 treatment aluminum alloy was heated to 1000° F. during the solution treatment process, the entire process required a significantly longer solution treatment time of 9 hours. By modifying the prior art process as described in FIG. 2, including the increased temperature used during Step 215, it is possible to decrease both the initial solution heating time and the artificial aging time, resulting in a total processing time of approximately 2 hours.

As described in FIG. 2, the exemplary method is carried out on a component cast from the modified A356 alloy as described in FIG. 1. In further exemplary embodiments, the exemplary method may be used on different aluminum alloys, including unmodified A356 alloy.

Using the low pressure permanent mold (LPPM) casting method, the modified A356 alloy, as described in FIGS. 1 and 2 yields approximately 32% improvement for impact toughness.

What is claimed is:

1. A method for transforming the impact toughness coefficient of an aluminum component consisting essentially of the steps of:

casting a cast component from a modified aluminum alloy using a low pressure permanent mold (LPPM) casting process, wherein said modified aluminum alloy consists essentially of up to 0.20% copper, up to 0.10% manganese, less than 0.12% iron, up to 0.10% zinc, up to 0.90% magnesium by weight, up to 0.20% titanium by weight, silicon and a balance of aluminum, wherein said modified aluminum alloy contains a silicon-to-magnesium product ratio R of 4.0, wherein R is determined using the formula R=M×S, wherein M is a percentage of Magnesium in said modified aluminum alloy and S is a percentage of Silicon in said modified aluminum alloy;

heating said cast component at a solution treatment temperature for up to one hour;

cooling said cast component by quenching;

heating said cast component at a second temperature for up to one hour; and cooling said cast component.

2. The method of claim 1 wherein said modified aluminum alloy contains between 0.55% and 0.60% magnesium by weight.

3. The method of claim 1 wherein said modified aluminum alloy contains between 0.10% and 0.15% titanium by weight.

4. The method of claim 1 wherein said modified aluminum alloy contains up to 0.20% zirconium by weight.

5. The method of claim 1 wherein said modified aluminum alloy contains between 0.10% and 0.15% zirconium by weight.

6. The method of claim 1 wherein said modified aluminum alloy contains less than 0.07% iron by weight.

7. The method of claim 1 wherein said modified aluminum alloy contains less than 0.15% total impurities by weight.

8. The method of claim 1 wherein the silicon morphology of said modified aluminum alloy is modified with strontium.

9. The method of claim 1 wherein said first solution treatment temperature is 1,000° F.

10. The method of claim 1 wherein said second temperature is between 350° F. and 390° F.

11. The method of claim 1 which further includes the step of thermally coating said cast component, wherein said thermal coating process is selected from the group consisting of a short bake paint cycle and a powder coating process.

* * * * *